United States Patent [19]

Zieren

[11] Patent Number: 4,763,584

[45] Date of Patent: Aug. 16, 1988

[54] MEANS OF ATTACHING REFRACTORY TO A FURNACE WALL

[75] Inventor: Marten L. Zieren, Stittsville, Canada

[73] Assignee: Combustion Engineering, Inc., Windsor, Conn.

[21] Appl. No.: 20,812

[22] Filed: Mar. 2, 1987

[51] Int. Cl.[4] ..... F23M 9/00

[52] U.S. Cl. ..... 110/323; 110/336; 110/338

[58] Field of Search ..... 110/331, 332, 333, 336, 110/337, 338, 339, 340, 322, 323; 122/493, 6 A; 52/573, 506, 509, 513, DIG. 5

[56] References Cited

U.S. PATENT DOCUMENTS

| | | | |
|---|---|---|---|
| 1,137,600 | 4/1915 | Gallagher | 122/493 X |
| 1,359,587 | 11/1920 | Flannery | 122/493 X |
| 3,019,561 | 2/1962 | Weber | 110/331 X |
| 3,295,280 | 1/1967 | Kettner | 110/336 X |
| 4,323,718 | 4/1982 | Buhring et al. | 110/331 X |
| 4,473,983 | 10/1984 | Vance | 110/336 X |
| 4,569,659 | 2/1986 | Olsen et al. | 110/336 X |

FOREIGN PATENT DOCUMENTS

| | | | |
|---|---|---|---|
| 3604493 | 12/1986 | Fed. Rep. of Germany | 110/338 |

*Primary Examiner*—Steven E. Warner
*Attorney, Agent, or Firm*—Arthur E. Fournier, Jr.

[57] ABSTRACT

A furnace water cooled tube wall portion (10) is separated from heated gasses by cast refractory material (12). A metal isolation plate (14) against the tubes (18) separates the tubes from the refractory material (12) and has projecting elongated anchors (30) with shanks (32) attached at spaced locations to mechanically join the refractory material to isolation plate (14). Anchors (30) have conical chamber washers welded to shanks (32) to shield the locations from cast refractory material at the spaced location. This permits bending of shanks (32) to accommodate thermal expansion force created movement between isolation plate (14) and the refractory material (12).

3 Claims, 1 Drawing Sheet

MEANS OF ATTACHING REFRACTORY TO A FURNACE WALL

FIELD OF THE INVENTION

This invention relates to wall and roof structures for furnaces of the type having metal structural wall members separated from heated gasses by cast refractory material. Typically, the furnace wall includes a plurality of parallel water conducting metal tubes connected by fins.

BACKGROUND OF THE INVENTION

When castable refractory material is used for the construction of furnace wall structures to separate the combustion chamber or heated gasses from the metal structural members or tubes of the wall, relative movement is caused by the difference in thermal expansion between the metal members, plates or tubes of the wall, which may be of carbon steel, and the castable refractory material, which may, for example, be "MOLDIT D", a product of C-E Refractories, a unit of Combustion Engineering, Inc., the assignee of the present application.

Carbon steel, from which the structural members of the tube wall may be made, has a mean coefficient of thermal expansion of 7 to $8\times10^{-6}$ per degree F. (12.6 to $14.3\times10^{-6}$ per degree C.), for example, in a typical service range of from 500° to 1000° F. In a similar range of temperatures, "MOLDIT D" has a mean coefficient of thermal expansion of approximately $3\times10^{-6}$ per degree F. ($5.4\times10^{-6}$ per degree C.). This is with a recommended bulk density, cured and dried, of 124 pounds per cubic foot. "MOLDIT D" has a nominal chemical analysis (calcined basis) of percent by weight as follows:

$Al_2O_3$—45.0
$SiO_2$—36.9
CaO—13.0
$Fe_2O_3$—1.5
FeO—2.2
$TiO_2$—1.1

It is a representative castable material of the type used on furnace walls.

The present invention is designed to accommodate the movement between the metal members of the furnace wall and the cast refractory material. A previous attempt to accommodate this movement is disclosed in U.S. Pat. No. 3,019,561 to Weber. The novel means for accomplishing this accommodation of the relative movement has been devised upon a realization that a free bending force acting on an elongated anchor member will permit the relative motion with a minimum of damage, if any, to the refractory material. Heretofore, such relative motion has created a damaging shear force between the anchors and the metal structural members which tends to destroy the joint between the anchor and the metal member, break the anchor and damage the castable refractory material.

BRIEF DESCRIPTION OF THE INVENTION

The invention is for use in a furnace having a wall which includes a metal structural member and a cast refractory body separating the metal structural member from the combustion chamber or heated gasses. In order to secure castable refractory material to metal structural or wall members in furnace walls and roofs it is necessary and customary to use elongated metal anchors which are secured to the metal structural members at spaced locations. These elongated metal anchors are usually welded to the structural member and project from it in the direction of the heated gasses.

The novel construction of the invention provides a conical chambered washer on the shank or elongated portion of each anchor which acts to shield the location of the joinder of the anchor with the structural member from cast refractory material during the gunning or casting process. With the conical member firmly attached to the shank of the anchor, as by welding, the conical chamber formed by the washer remains void and refractory material is cast up against only its outer surface, thus shielding the locations at which the anchors are joined to the structural member or wall.

In one embodiment an isolation plate is mounted on the crowns of tubes of a tube wall and this defines the structural member to which the anchors are attached at spaced locations. Because of the described structure, the shank of the anchor moves relative to the structural member by bending in the area free of cast refractory material within the conical chamber washer under the thermal expansion forces of the metal anchors and the metal structural member and the cast refractory material. Thus, the anchor bends instead of shears. In the case of the isolating plate embodiment, as the plate expands with the furnace tube wall, and therefore moves, the conical chamber washer allows the anchor pin to bend and thereby prevents its shearing off or cracking of refractory material adjacent to it, as the isolating plate provides a flat shear plane to allow for movement of the furnace tube wall.

DETAILED DESCRIPTION OF THE PREFERRED EMBODIMENT

Figure 1:
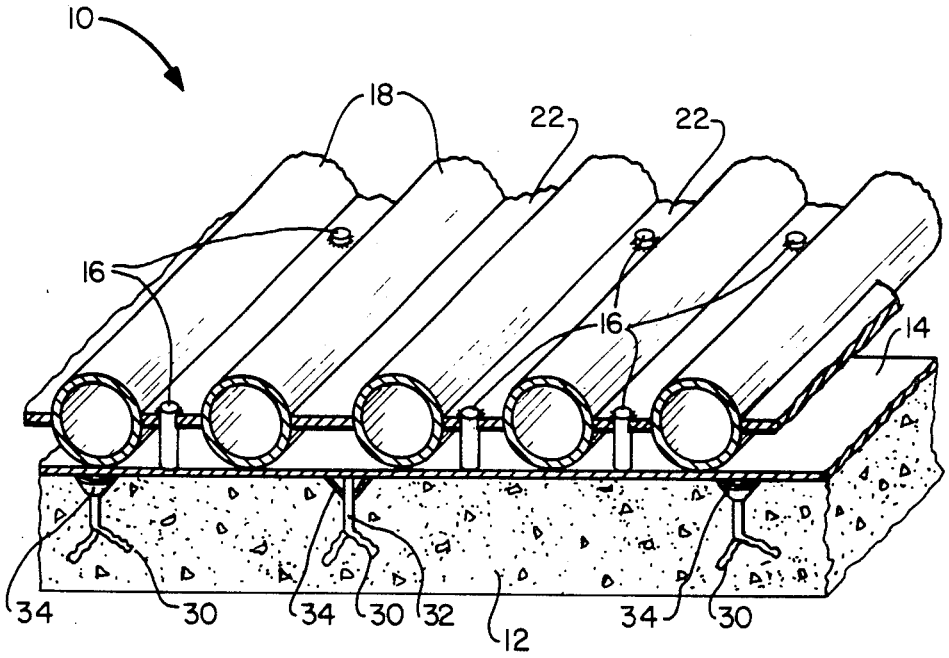
FIG. 1 is a fragmentary isometric view of a portion of a furnace wall having a metal wall and tube fin attached by retaining pins to an isolating plate structural member with anchors and refractory material on the side of the metal structural members toward the heated gasses.

The numeral 10 generally designates a fragmentary section of a furnace wall. The section also could be a portion of a furnace ceiling, but it will be noted that it includes a lower layer of refractory material 12 which has been cast against a metal structural member or isolation plate 14. The refractory material 12 is attached by means of retaining pins 16 to tubes 18 of a water cooled carbon steel wall structure 20, which includes fins 22 between the tubes 18. The isolation plate 14 rests against the tube crowns and the retaining pins 16 are welded to the plate 18 at spaced locations and protrude through and are welded to the fin structure 22 as seen in FIG. 1.

The isolation plate 14 has anchor members 30 welded to it at spaced locations on its side adjacent the furnace combustion chamber or the heated gasses such that the refractory material 12, when cast against the isolation plate 14 or other structural member, depending upon the furnace design, will be mechanically anchored and held against the plate. As long as the anchors 30 are elongated to some degree, their shape is not critical. It is preferable, if they have a shank portion and then a change of direction of the projecting ends. The illustrated anchors 30 are U-shaped wire or rod members with the bight of the "U" being flattened and welded against the structural member or isolation plate 14. The free ends of the two legs of the "U" are bent out of the plane of the "U" to provide better holding of the refractory material 12. Regardless of their exact shape, anchors 30 should have an elongated shank portion 32 upon which a conical chamber washer 34 may be welded, as illustrated by weld material 36.

Figure 2:
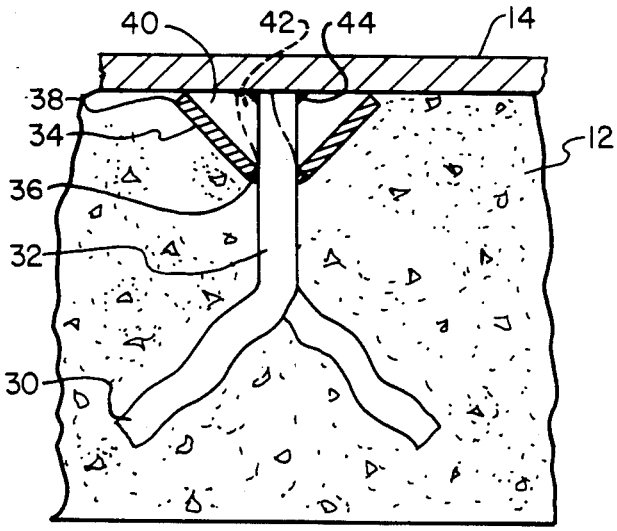
FIG. 2 is a detailed cross-sectional view of the anchor and conical chamber washer combination mounted on the metal structural member isolating plate of FIG. 1.

At the outer perimeter 38 of the washer 34 there should be no weld and the conical washer should be against the structural member of isolation plate 14 but free to move along the surface thereof due to forces of thermal expansion. The movement will be created by the earlier noted difference between the thermal expansion coefficient of the refractory material 12 and that of the isolation plate 14. The conical chamber washer 34 creates a shielded volume 40 which is substantially free of refractory material 12 thus permitting a bending of the shank 32 as shown by dotted line 42 in FIG. 2. Without the ability of the shank 32 of the anchor to bend in this manner, the anchor would be more likely to shear from the plate 14 in the area of weld material 44 which connects the bight of the anchor 30 to the plate 14.

Thus, it will be seen that an improved means for attaching refractory to a furnace tube wall is provided in which a conical chamber washer is secured to the shank of an elongated anchor member to provide an area shielded from refractory material to give adequate room for bending rather than shearing of the anchor, as the structural member to which it is attached expands and moves relative to the cast refractory material.

What is claimed is:

1. In a furnace having a wall which includes a metal structural member and a cast refractory body separating said metal structural member from heated gasses, the improvement comprising:

(a) elongated metal anchors secured to said structural member at spaced locations and projecting from said structural member in the direction of said heated gasses, said elongated metal anchors each having a shank portion; and (b) means for shielding said location from said cast refractory material thereby providing voids in said cast refractory material at said spaced locations where said elongated metal anchors are secured to said metal structural member, said means for shielding being connected to said elongated metal anchors, said means for shielding being a conical chamber washer mounted on said elongated metal anchor by being welded to said shank portion thereof.

2. The furnace of claim 1 in which the shank moves relative to the structural member by bending in the area free of cast refractory material within said conical chamber washer under the thermal expansion forces of said metal anchors said metal structural member and said cast refractory material.

3. The furnace of claim 1 in which the conical chamber washer is not directly secured to said structural member.

* * * * *